US008042649B2

(12) United States Patent
Inoue

(10) Patent No.: US 8,042,649 B2
(45) Date of Patent: Oct. 25, 2011

(54) VEHICULAR MUFFLER AND MOTORCYCLE INCORPORATING SAME

(75) Inventor: Yusuke Inoue, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/707,767

(22) Filed: Feb. 18, 2010

(65) Prior Publication Data

US 2010/0213000 A1 Aug. 26, 2010

(30) Foreign Application Priority Data

Feb. 26, 2009 (JP) ..... 2009-044311

(51) Int. Cl.
*F01N 1/10* (2006.01)

(52) U.S. Cl. ..... 181/252; 181/212; 181/227; 181/247; 181/256; 181/257

(58) Field of Classification Search ..... 181/252, 181/227, 212, 256, 257, 238, 247, 251
See application file for complete search history.

(56) References Cited

U.S. PATENT DOCUMENTS

| | | | | |
|---|---|---|---|---|
| 4,108,276 | A * | 8/1978 | Hall et al. | 181/256 |
| 4,712,644 | A * | 12/1987 | Sun | 181/251 |
| 5,033,581 | A * | 7/1991 | Feuling | 181/257 |
| 5,198,625 | A * | 3/1993 | Borla | 181/248 |
| 5,608,194 | A * | 3/1997 | Okazaki et al. | 181/228 |
| 7,624,842 | B2 * | 12/2009 | Mizutani | 181/249 |

FOREIGN PATENT DOCUMENTS

JP 2006-307793 11/2006

* cited by examiner

*Primary Examiner* — Forrest M Phillips
(74) *Attorney, Agent, or Firm* — Carrier Blackman & Associates, P.C.; William D. Blackman; Joseph P. Carrier

(57) ABSTRACT

A vehicular muffler is configured and arranged to smoothly introduce exhaust gas into a sound-absorbing material disposed inside of an outer case which has a plurality of relatively short inner sleeves therein. The muffler includes a porous plate which is disposed inside of the outer case, and which is connected to an exhaust pipe, and the porous plate is operatively connected to an outlet pipe which discharges an exhaust gas to the outside environment through an opening formed in an outlet side of the outer case. In one embodiment, the inner sleeves are arranged substantially parallel to each other, and are fluidly connected to a joint exhaust feed pipe disposed inside the outer case. The inner sleeves are connected to the outlet pipe on the outlet side of the outer case.

16 Claims, 9 Drawing Sheets

VEHICULAR MUFFLER AND MOTORCYCLE INCORPORATING SAME

CROSS-REFERENCE TO RELATED APPLICATIONS

The present invention claims priority under 35 USC 119 based on Japanese patent application No. 2009-044311, filed on Feb. 26, 2009. The entire subject matter of this priority document, including specification, claims and drawings, is incorporated by reference herein.

BACKGROUND OF THE INVENTION

1. Field of the Invention

The present invention relates generally to mufflers used in a vehicle to filter engine exhaust in order absorb sound from an engine of the vehicle.

2. Description of the Background Art

A motorcycle muffler is known having a structure in which an inner sleeve is disposed inside of an outer case. A large number of holes are formed in the inner sleeve, and during operation, an exhaust gas from the engine enters the inner sleeve, and is discharged into the outer case through these holes. A large part of engine noise from the exhaust gas stream is absorbed by a sound-absorbing material in the outer case. Thereafter, the exhaust gas is discharged to the outside (see, for example, Patent Document 1).

[Patent Document 1] JP-A-2006-307793

However, in the above-mentioned conventional motorcycle muffler, although the exhaust gas can be smoothly introduced into the sound-absorbing material disposed inside of the outer case from the inside of the inner sleeve by forming the large number of holes in a peripheral surface of the inner sleeve, the number of holes which can be formed in and arranged on the inner sleeve is limited and hence, only the limited number of holes can be formed. Accordingly, there is a limit with respect to the smooth discharge of the exhaust gas into the sound-absorbing material. To cope with such a limit, it is necessary to increase the number of holes by elongating the inner sleeve. As a result, the muffler is elongated, thus giving rise to a drawback that the degree of freedom in designing a muffler is lowered.

SUMMARY OF THE INVENTION

Accordingly, it is an object of the present invention, in a first exemplary embodiment hereof, to provide a vehicular muffler which can shorten a length of an inner sleeve thereof, while providing a minimal amount of back pressure.

It is another object of the present invention, in a second exemplary embodiment hereof, to provide a vehicular muffler which can smoothly discharge an exhaust gas through a sound-absorbing material disposed inside of an outer case.

It is another object of the present invention, in a third exemplary embodiment thereof, to provide a vehicular muffler in which a plurality of inner sleeves are connected to an exhaust feed pipe by way of a first expansion chamber, and are connected to an outlet pipe by way of a second expansion chamber.

To achieve the above-mentioned first object, a first aspect of the present invention is directed to a muffler (for example, a muffler 22 in an embodiment) of a motorcycle which includes an outer case (for example, an outer case 42 in the embodiment) and a plurality of inner sleeves (for example, inner sleeves 43 in the embodiment) formed of a porous plate material, which sleeves are disposed inside of the outer case and are connected to an exhaust pipe (for example, an exhaust pipe 20 in the embodiment) and also to an outlet pipe (for example, a outlet pipe 49 in the embodiment) which discharges an exhaust gas to the outside on an outlet side of the outer case, wherein a plurality of the inner sleeves which are arranged parallel to each other are connected to the exhaust pipe disposed inside of the outer case, and the plurality of inner sleeves are connected to the outlet pipe on the outlet side of the outer case.

The invention called for in claim 2 is characterized in that the plurality of inner sleeves are connected to the exhaust pipe by way of a first chamber (for example, a first expansion chamber 45 in the embodiment) which constitutes an expansion chamber, and are connected to the outlet pipe by way of a second chamber (for example, a second expansion chamber 46 in the embodiment) which constitutes an expansion chamber.

The invention called for in claim 3 is characterized in that a bent portion (for example, a second bent portion 41 in the embodiment) is arranged in the vicinity of a connecting portion of the exhaust pipe which is connected to the outer case, and the plurality of inner sleeves disposed inside of the outer case are arranged such that the number of inner sleeves corresponding to a frame side of the bent portion of the exhaust pipe is larger than the number of inner sleeves corresponding to an outer side of the bent portion of the exhaust pipe.

The invention called for in claim 4 is characterized in that the bent portion is arranged in the vicinity of a connecting portion of the exhaust pipe which is connected to the outer case, and the plurality of inner sleeves disposed inside of the outer case are arranged such that a cross-sectional area of the inner sleeve corresponding to a frame side of the bent portion of the exhaust pipe is set larger than a cross-sectional area of the inner sleeve corresponding to an outer side of the bent portion of the exhaust pipe.

According to the invention called for in claim 1, the large number of holes can be formed by providing the plurality of inner sleeves and hence, it is possible to increase a total hole area compared to a case where a single inner sleeve is provided. As a result, a length of the inner sleeves can be shortened while ensuring a noise reduction effect thus bringing about an advantageous effect that a length of the muffler can be shortened.

According to the invention called for in claim 2, the first chamber and the second chamber which also function as expansion chambers respectively are provided on both ends of the plurality of inner sleeves respectively thus bringing about an advantageous effect that the noise reduction effect can be enhanced.

According to the inventions called for in claims 3 and 4, the exhaust gas which flows in the inner side of the exhaust pipe connected to the inner sleeves and bent right in front of the inner sleeves is larger in quantity than the exhaust gas which flows in the outer side of the exhaust pipe, and the larger quantity of exhaust gas is introduced into the inner sleeve having a larger number of holes or the inner sleeve having a larger cross-sectional area thus bringing about an advantageous effect that the exhaust gas passes through the muffler smoothly.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

Next, selected illustrative embodiments of the present invention are explained in conjunction with the accompanying drawings. Throughout this description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

Figure 1:
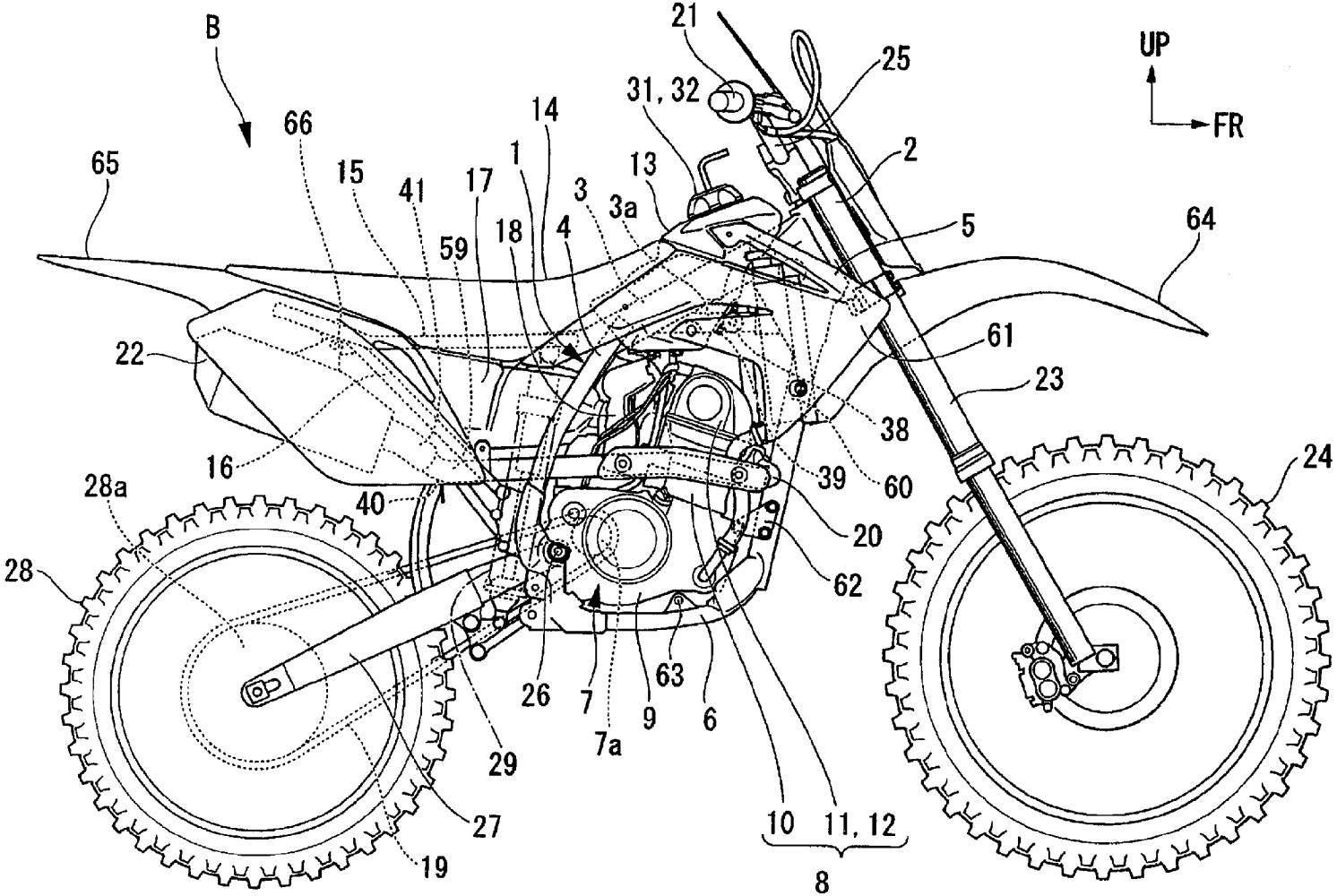
FIG. 1 is a side view of a motorcycle according to an illustrative embodiment of the present invention.
Figure 2:
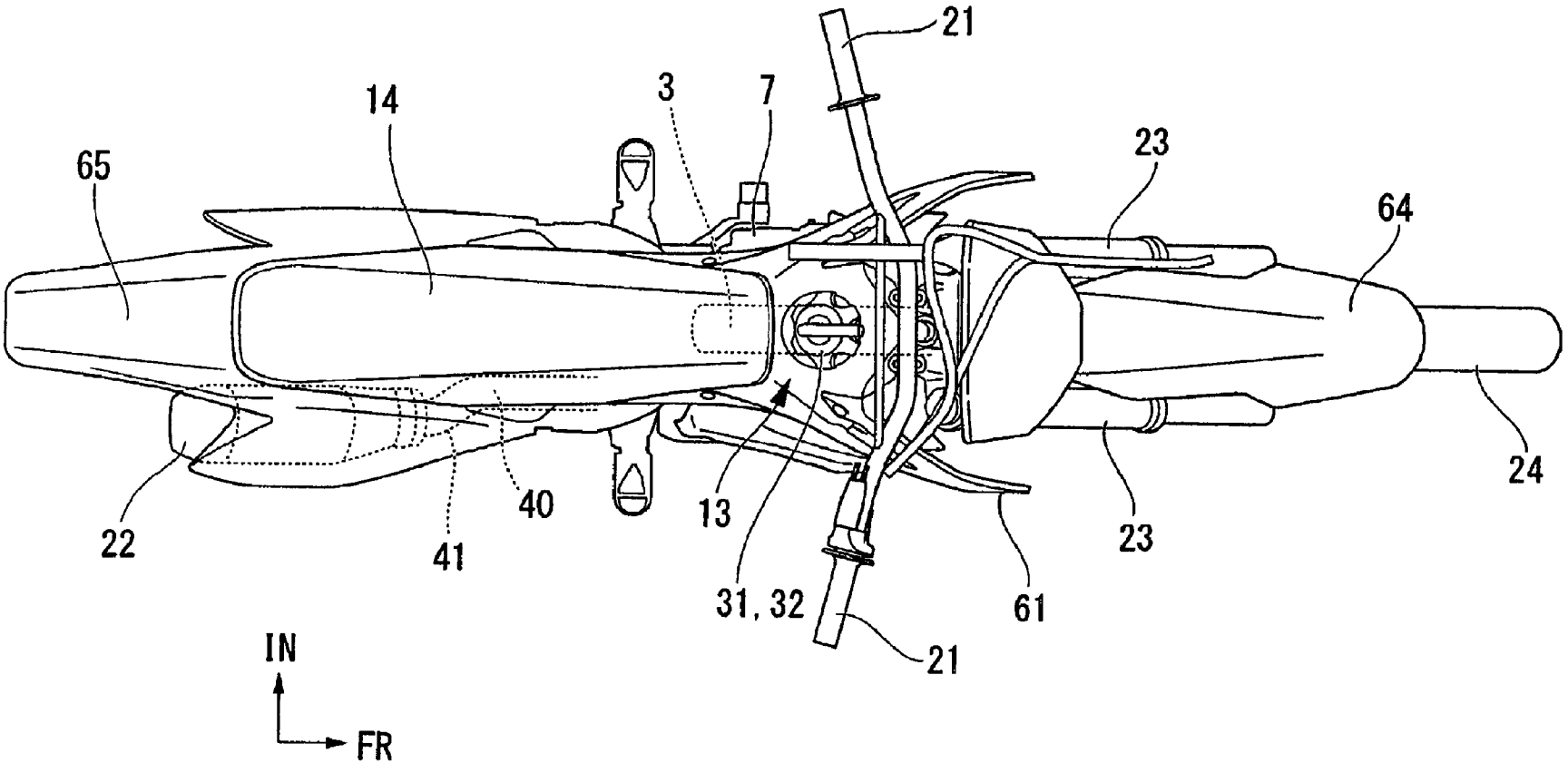
FIG. 2 is a top plan view of the motorcycle of FIG. 1.

FIG. 1 is a side view of an off-road-type motorcycle, and FIG. 2 is a plan view of the off-road-type motorcycle. Here, in the explanation made hereinafter, symbol "IN" indicates a frame side of a vehicle, symbol "OUT" indicates an outer side of the vehicle, symbol "FR" indicates a front side of the vehicle, and symbol "UP" indicates an upper side of the vehicle.

As shown in FIG. 1 and FIG. 2, a vehicle body frame 1 of a motorcycle B includes a head pipe 2, a main frame 3, center frames 4, down frames 5 and lower frames 6. The respective frames are connected to each other in a loop shape, and an engine 7 is supported on a frame side of the connected frames. The engine 7 includes a cylinder 8 and a crankcase 9.

The main frame 3 linearly extends obliquely in the downward and rearward direction on the center of the vehicle body and above the engine 7, and is connected to upper end portions of a pair of left and right center frames 4 which extends in the vertical direction behind a fuel tank 13 and the engine 7. The down frames 5 linearly and obliquely extend in the downward direction on the center of the vehicle body and in front of the engine 7, and have lower end portions thereof connected to front end portions of a pair of left and right lower frames 6. Each lower frame 6 is bent downwardly toward an area below the engine 7 from a front lower portion of the engine 7, extends substantially linearly in the rearward direction, and has a rear end portion thereof connected to a lower end portion of each center frame 4.

The engine 7 is a water-cooled 4-cycle engine, wherein the cylinder 8 is mounted on a front portion of the crankcase 9 in an upright state where a cylinder axis of the cylinder 8 becomes substantially perpendicular to a ground. The cylinder 8 includes a cylinder block 10, a cylinder head 11 and a head cover 12 which are arranged sequentially from the bottom to the top. By mounting the cylinder 8 in an upright state, a length of the engine 7 in the longitudinal direction can be shortened and hence, the engine 7 has the constitution suitable for an off-road vehicle.

The fuel tank 13 is arranged above the engine 7 and is supported on the main frame 3. To be more specific, a support frame 3*a* extends between the main frame 3 and the head pipe 2 at a corner portion made by the main frame 3 and the head pipe 2. The fuel tank 13 is fixed to the support frame 3*a* using a bolt 39 by way of mounting brackets 38 arranged between lower surfaces of both sides of the fuel tank 13 and both side portions of the support frame 3*a*. A seat 14 is arranged just behind the fuel tank 13, and is supported on a seat rail 15 which extends in the rearward direction from an upper end of the center frame 4. A rear frame 16 is arranged below the seat rail 15. An air cleaner 17 is supported on the seat rail 15 and the rear frame 16, and air is taken into the cylinder head 11 by way of a carburetor 18 from a vehicle-body rear side. Here, with respect to the fuel tank 13, a filler cap 31 is mounted on an oil filling port 32.

A front fork 23 is supported on the head pipe 2, and a front wheel 24 which is supported on a lower end portion of the front fork 23 is steered by a handle 25. Here, a grip 21 is mounted on left and right end portions of the handle 25, and the right end portion of the handle 25 constitutes a throttle-use grip 21. A front end portion of a rear swing arm 27 is swingably supported on the center frame 4 using a pivot shaft 26.

A rear wheel 28 is supported on a rear end portion of the rear swing arm 27, and the rear wheel 28 is driven by a drive chain 19 which extends between and is wound around a drive sprocket wheel 7*a* of the engine 7 and a driven sprocket wheel 28*a* of the rear wheel 28. The drive chain 19 is routed around the rear swing arm 27 on a left side of the vehicle body in the longitudinal direction and is moved in the vertical direction along with the vertical swinging of the rear swing arm 27 about the pivot shaft 26. Further, a rear-suspension-type cushion unit 29 is arranged between the rear swing arm 27 and a rear end portion of the center frame 4. In FIG. 1, numeral 60 indicates a radiator, numeral 61 indicates a radiator shroud, numerals 62, 63 indicate engine mount portions, numeral 64 indicates a front fender, and numeral 65 indicates a rear fender.

Here, an exhaust pipe 20 is mounted on a front portion of the cylinder 8 of the engine 7. The exhaust pipe 20 extends from a front portion of the cylinder 8 to an area in front of the crankcase 9, is bent to a right side, and extends in the rearward direction on a right side of the vehicle body. Then, the exhaust pipe 20 is bent toward a right oblique upper side, which constitutes an outer side at a first bent portion 40. Then, rearward of the first bent portion 40, the exhaust pipe 20 is bent toward a left oblique lower side at the second bent portion 41 in front of the muffler 22, extends in the rearward direction, and is connected to the muffler 22. The muffler 22 extends in the rearward direction on a right side. A rear end portion of the muffler 22 is supported on the rear frame 16.

Figure 3:
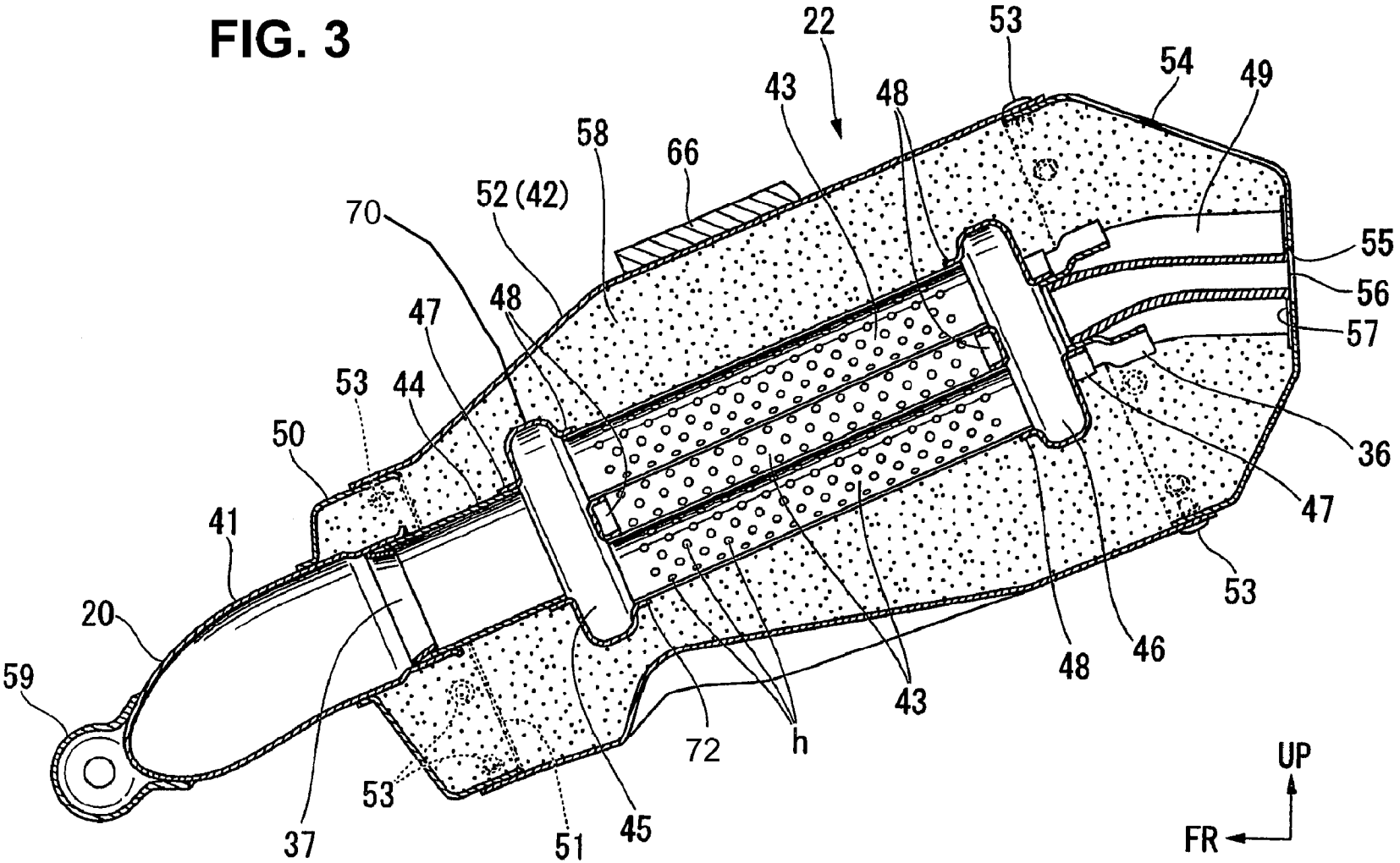
FIG. 3 is a cross-sectional view of a muffler which is a component part of the motorcycle of FIG. 1.
Figure 4:
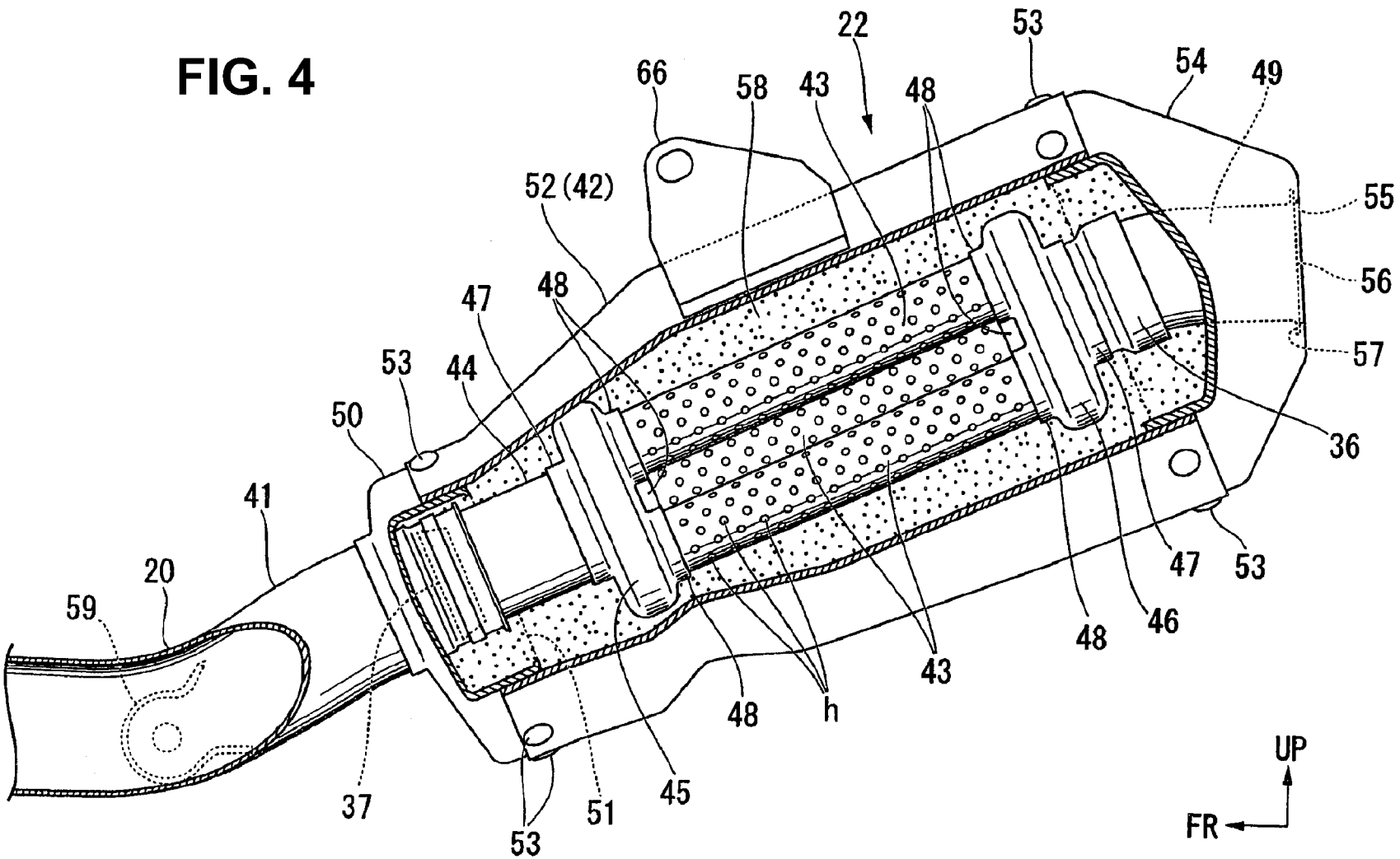
FIG. 4 is a cross-sectional view of an outer case portion of the muffler 22, with a part of the pipe shown broken away for purposes of illustration.

FIG. 3 is a cross-sectional view of the muffler 22, and FIG. 4 is a cross-sectional view of an outer case portion of the muffler 22, with a part of the pipe shown broken away for purposes of illustration.

As shown in FIG. 3 and FIG. 4, the muffler 22 includes the hollow outer case 42 and three inner sleeves 43 which are disposed inside of the outer case 42. A diameter of a rear end portion of the exhaust pipe 20 is slightly decreased and, thereafter, is increased. In the depicted embodiment, a front end portion of a joint exhaust feed pipe 44 is inserted into, and fixed to this rear end portion of the exhaust pipe 20. Here, an inner restriction ring 37, whose diameter is gradually decreased in the rearward direction, is fixed to an inner wall of the end portion of the exhaust pipe 20. The front end portion of the joint exhaust feed pipe 44 receives, and is welded on to an outer side of the restriction ring 37. The font end portion of the joint exhaust feed pipe 44 also is inserted into and welded to an end portion of the exhaust pipe 20.

Figure 7:
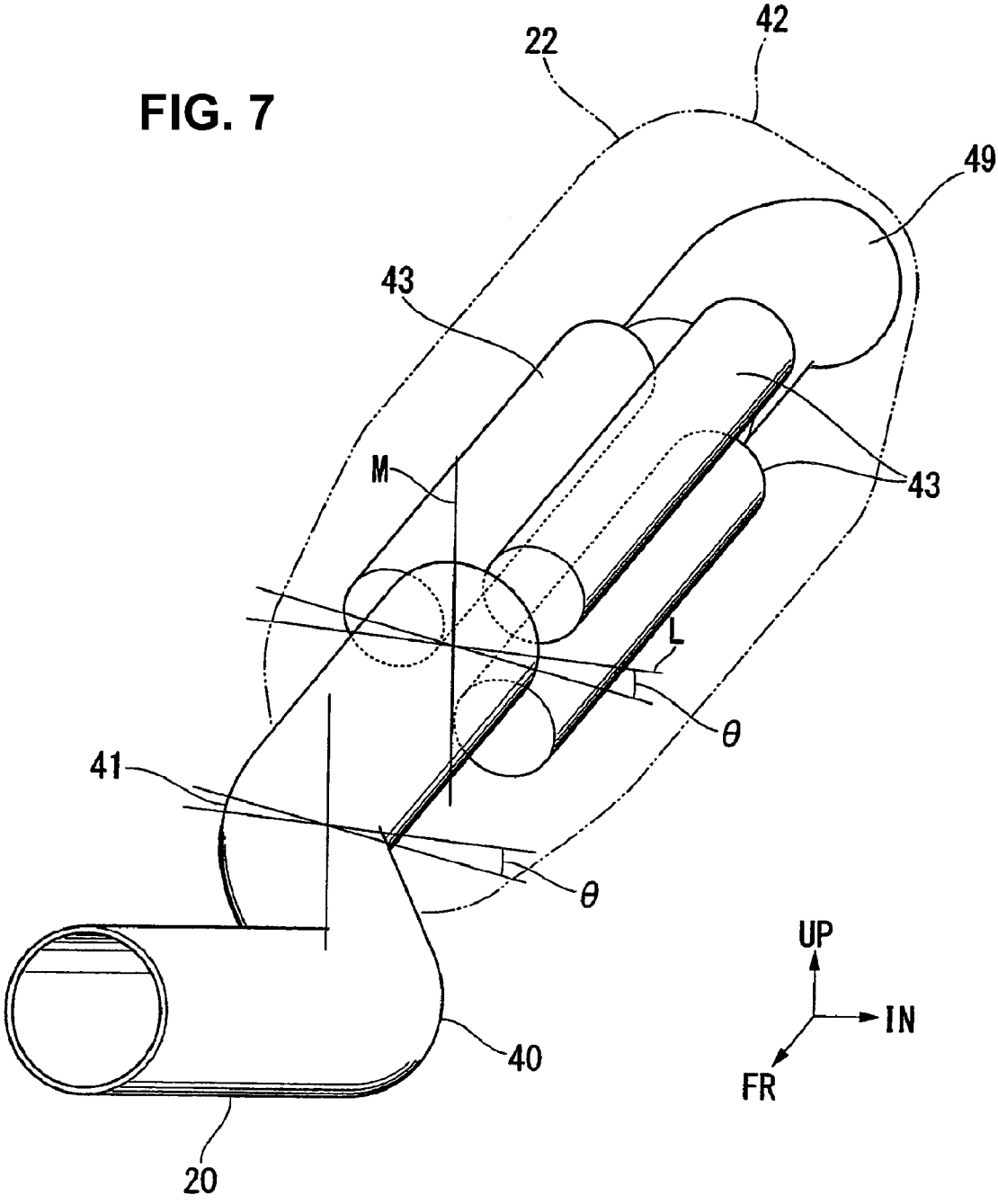
FIG. 7 is a perspective view showing the positional relationship between the rear portion of the exhaust pipe and the inner sleeves.
Figure 8:
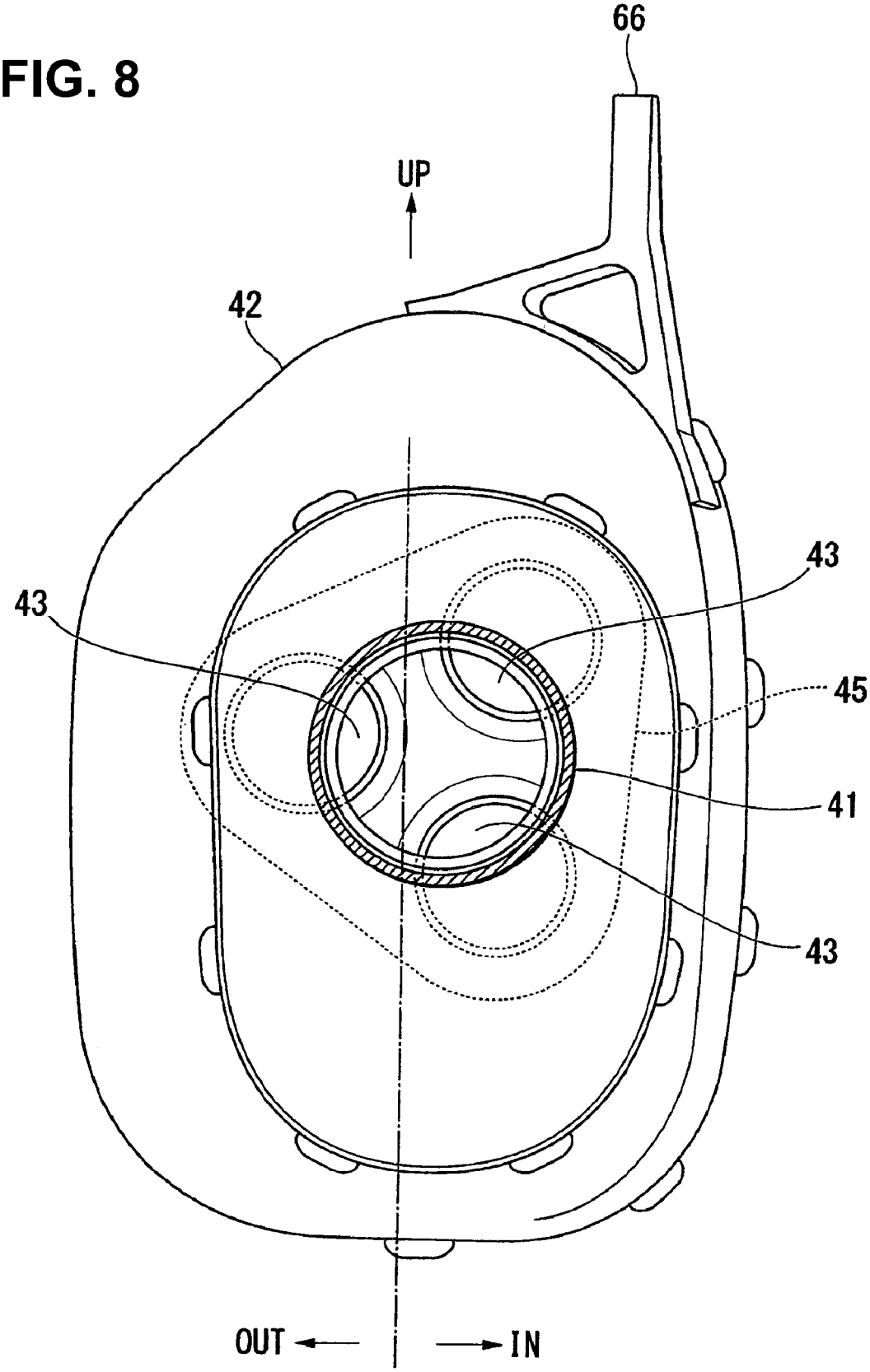
FIG. 8 is a front cross-sectional view showing the positional relationship between the rear portion of the exhaust pipe and the inner sleeves.

The first expansion chamber 45 is connected to a rear end of the joint exhaust feed pipe 44. The first expansion chamber 45 is a substantially disc-shaped hollow member having a diameter larger than a diameter of the joint exhaust feed pipe 44. On an inlet port side of the first expansion chamber 45, a receiving sleeve 47 is formed in a raised manner, and this receiving sleeve receives the rear end portion of the joint exhaust feed pipe 44 therein, and is communicated with an inner space. The receiving sleeve 47 has a first sleeve diameter thereacross which is slightly larger than, and which closely conforms to the size and shape of the joint exhaust feed pipe 44 which is received therein. Immediately adjacent to and downstream from the receiving sleeve, the first expansion chamber 45 expands outwardly to form a substantially disc-shaped enlarged portion 70 having a maximum chamber diameter which is larger than the first sleeve diameter. On an outlet port side of a rear surface of the first expansion chamber 45, the first expansion chamber 45 forms a neck portion 72 which is reduced in diameter to be smaller than the enlarged portion 70, and the neck portion includes three separate spaced-apart receiving sleeve portions 48, which receive three inner sleeves 43 therein, and which are integrally formed in a raised manner. As seen in FIGS. 7 and 8, the three inner sleeves 43 are arranged at vertex positions of an equilateral triangle.

Each of the inner sleeves 43 is produced by forming a perforated material, which constitutes a porous plate having a large number of holes h formed therein, into a tubular sleeve shape. It will be seen from a comparison of FIGS. 3, 7 and 8 that the tubular inner sleeves 43 have openings formed therein along substantially the entire length thereof, and are spaced away from each other so as to be out of contact with one another. Three inner sleeves 43 have the substantially same constitution respectively, are connected parallel to each other, and are respectively set at particular arrangement positions described later.

The second expansion chamber 46 is connected to rear portions of the respective inner sleeves 43. The second expansion chamber 46 is a disc-shaped hollow member having substantially the same constitution as the first expansion chamber 45, and is arranged in a longitudinally reversed manner compared to the first expansion chamber 45. Further, on a front surface of the second expansion chamber 46, to which rear ends of the inner sleeves 43 are connected, three receiving sleeve portions 48 are provided which allow the insertion of the respective inner sleeves 43 therein, and these sleeve portions are communicated with the inner space of the second chamber. The receiving sleeves 48 are arranged at three vertex positions of an equilateral triangle, corresponding to the three inner sleeves 43. Here, the vertexes of the equilateral triangle are aligned with positions of the inner sleeves 43 which are connected to a rear surface of the first expansion chamber 45. Accordingly, three inner sleeves 43 are arranged and connected parallel to each other between the first and second expansion chambers 45, 46.

The receiving sleeve 47 is formed on a center portion of a rear surface of the second expansion chamber 46 in a raised manner, and a front end portion of the outlet pipe 49, which discharges an exhaust gas to the outside, is inserted into and fixed to the receiving sleeve 47 by way of an insertion ring 36. The outlet pipe 49 has a rear end portion thereof bent slightly downwardly, as shown.

The outer case 42 is provided so as to cover a portion of the muffler 22 ranging from a connection portion between a rear end portion of the exhaust pipe 20 and the joint exhaust feed pipe 44 to a rear end portion of the outlet pipe 49 from the outside.

The outer case 42 includes a front end plate 50 which is joined to a rear portion of the exhaust pipe 20, to be more specific, a front side of the connection portion between the exhaust pipe 20 and the joint exhaust feed pipe 44. A diameter of a rear opening portion 51 of the front end plate 50 is enlarged, and a front edge portion of a generally tubular outer case body 52, which receives the rear opening portion 51, is fixed to the front end plate 50 by rivets 53.

The outer case body 52 extends rearwardly in a state where an upper portion of the outer case body 52 is slightly inclined, gradually increases a diameter thereof, and covers the outlet pipe 49 at a position behind the second expansion chamber 46. A rear end cap 54, which fits into an end portion of the outer case body 52 at a front end portion thereof, is fixed to the end portion of the outer case body 52 by additional rivets 53.

The rear end cap 54 has an opening portion 55 formed therein, and this opening is aligned with a rear end portion of the outlet pipe 49 to provide an outlet for the muffler 22 at a rear opening portion 56 thereof, and the rear end of the rear end cap 54 is closed except for the opening portion 55. A transverse flange portion 57 is formed surrounding the opening portion 56 of the outlet pipe 49, and the flange portion 57 is fixed to the rear end cap 54 at a periphery of the opening portion 55.

Further, a sound-absorbing material 58, such as glass wool or the like, is filled inside of the outer case 42, that is, inside of the front end plate 50, inside of the outer case body 52, and inside of the rear end cap 54 and, at the same time, outside the joint exhaust feed pipe 44, outside the first expansion chamber 45, outside three inner sleeves 43, outside the second expansion chamber 46, and outside the outlet pipe 49. Optionally, the sound-absorbing material 58 may also be filled inside of the outlet pipe 49 and the inner sleeves 43, if desired. In FIG. 3, numeral 59 indicates a mounting seat for the exhaust pipe 20, and numeral 66 indicates a portion of a mounting bracket for the outer case 42.

Figure 5:
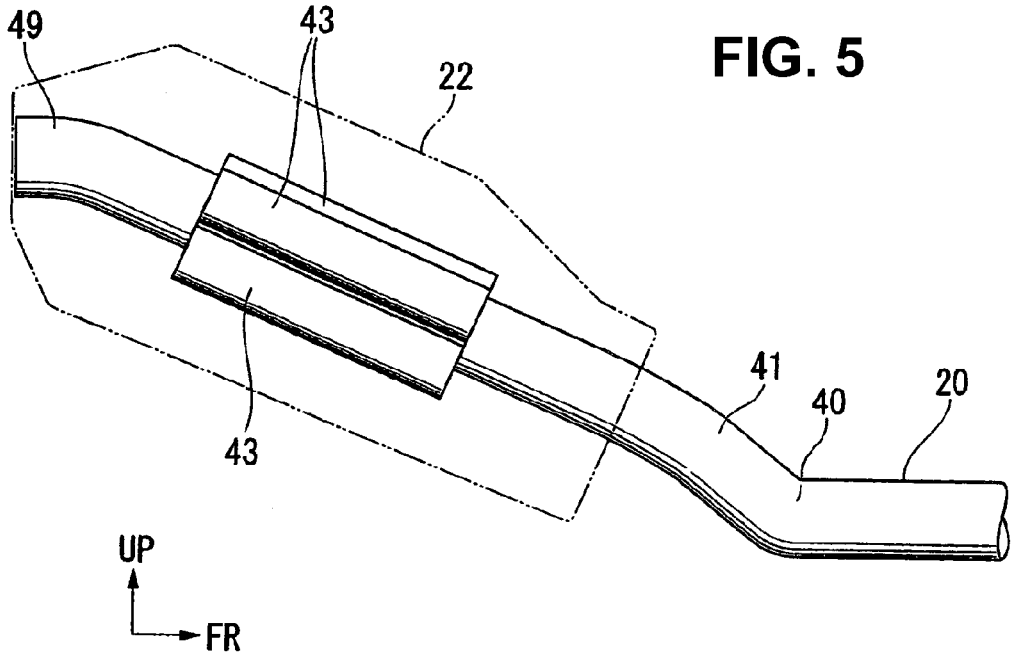
FIG. 5 is a side view showing a positional relationship between a rear portion of an exhaust pipe and inner sleeves.
Figure 6:
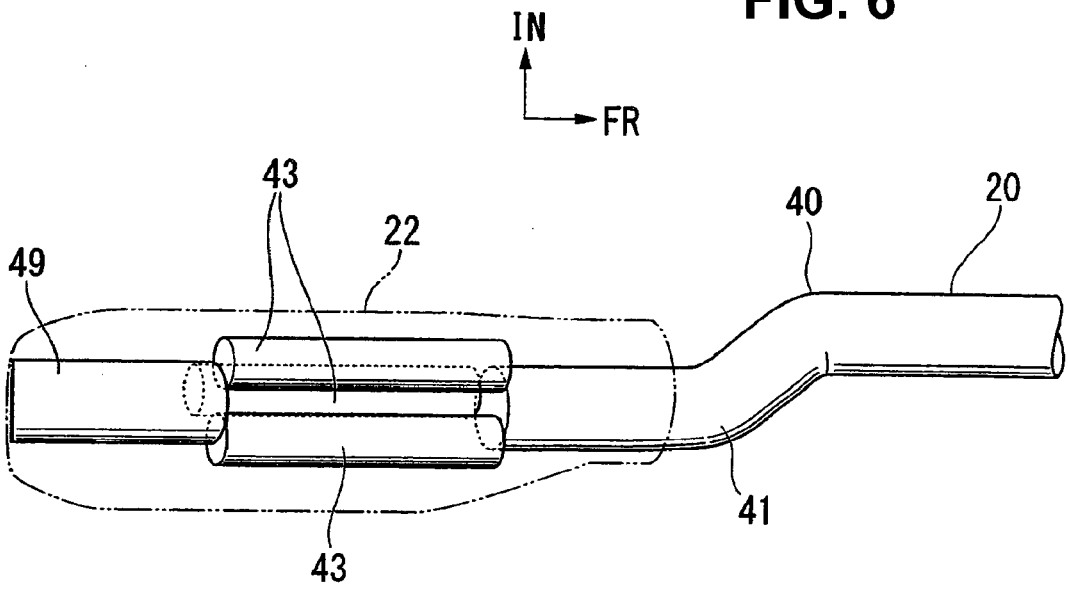
FIG. 6 is a top plan view showing the positional relationship between the rear portion of the exhaust pipe and the inner sleeves.

FIG. 5 to FIG. 7 are simplified drawings for facilitating the explanation of the arrangement of the inner sleeves 43, showing positions where three inner sleeves 43 are arranged in a radial direction about a central longitudinal axis of the muffler 22, corresponding to the second bent portion 41 arranged just in front of the exhaust pipe 20. Accordingly, the expansion chambers 45, 46 are omitted from these drawings, and other components except for the exhaust pipe 20, the inner sleeves 43, and the outer case 42 are also omitted from the drawings in FIGS. 5-7.

As can be understood from FIG. 1 which is a side view of the motorcycle and FIG. 5 which is a side view showing positions of the inner sleeves 43, the exhaust pipe 20 includes the first bent portion 40 which is bent substantially at an angle in front of the muffler 22. The exhaust pipe 20 is connected to the muffler 22 by way of the second bent portion 41 which is bent in a slightly upwardly projecting manner just in front of the muffler 22.

On the other hand, as can be understood from FIG. 2 which is a plan view of the motorcycle and FIG. 6 which is a plan view showing the positions of the inner sleeves 43, the first bent portion 40 projects inwardly, and the second bent portion 41 projects outwardly.

FIG. 7 is a perspective view showing a positional relationship between the exhaust pipe 20 and three inner sleeves 43 as viewed from a front oblique right side of the vehicle for facilitating the understanding of a state where the exhaust pipe 20 is bent, and FIG. 8 is a front view showing the positional relationship between the exhaust pipe 20 and three inner sleeves 43 shown in FIG. 7.

As shown in FIG. 7 and FIG. 8, assume a case where a horizontal azimuth and a vertical axis are depicted at a position of the second bent portion 41. In this embodiment, the bending direction of the second bent portion 41 is inclined by θ with respect to the axis in the horizontal direction. To express this state by assuming an axis in the horizontal direction as L and an axis in the vertical direction as M at the arrangement position of the inner sleeves 43, with respect to a line segment which is inclined by θ by taking such inclination of the bending direction of the second bent portion 41 into consideration, two inner sleeves 43 are arranged in a distributed manner astride the line segment inclined by θ on a frame side of the line segment (vehicle-body inner side) and one inner sleeve 43 is arranged on the line segment inclined by θ on an outer side of the line segment.

That is, the inner sleeves 43 are arranged such that the number of (inboard) inner sleeves 43 corresponding to a frame side of the second bent portion 41, arranged in the vicinity of the connection portion of the exhaust pipe 20 connected to the front end plate 50 of the outer case 42, is larger than the number of (outboard) inner sleeves 43 corresponding to an outer side of the second bent portion 41. In this embodiment, out of three inner sleeves 43, two inner sleeves 43 are arranged on the frame side of the second bent portion 41 of the exhaust pipe 20, and remaining one inner sleeve 43 is arranged on the outer side of the second bent portion 41.

According to the above-mentioned embodiment, an exhaust gas which is discharged from the engine 7 flows rearwardly in the exhaust pipe 20 and reaches the joint exhaust feed pipe 44 arranged inside of the muffler 22 through the first bent portion 40 and the second bent portion 41. The exhaust gas which reaches the joint exhaust feed pipe 44 expands in the first expansion chamber 45, so that a pressure of the exhaust gas is lowered and then, the exhaust gas is introduced into the inside of the three inner sleeves 43, which are connected to the first expansion chamber 45.

The introduced exhaust gas is further introduced into the inside of the outer case 42 through the large number of holes h of the inner sleeves 43, and a large part of the exhaust noise is then absorbed by the sound-absorbing material 58. The exhaust gas then flows back into the inside of the inner sleeves 43 via the holes h again and, thereafter, the exhaust gas expands in the second expansion chamber 46 again so that a pressure of the exhaust gas is lowered. Due to such a process, the exhaust gas whose pulsation is received and absorbed, and whose noise is reduced, is discharged to the outside of the muffler 22 via the outlet pipe 49 and the rear opening portion 56 of the outer case 42.

Here, three inner sleeves 43 are arranged inside of the muffler 22 and hence, it is possible to introduce the exhaust gas into the outer case 42 by allowing the exhaust gas to pass through the large number of holes h which are formed in walls of the respective inner sleeves 43 while substantially minimizing back pressure. Accordingly, compared to a case where the single inner sleeve 43 is arranged inside of the muffler 22, a total area of the holes h can be increased so that a length of the muffler 22 can be reduced.

Further, by arranging the first chamber 45 and the second expansion chamber 46 which also function as the expansion chamber on front and rear sides of three inner sleeves 43 respectively, the noise reduction effect can be enhanced.

Further, a quantity of exhaust gas which flows in the frame side of the bent exhaust pipe 20 just in front of the connection portion of the exhaust pipe 20 connected to three inner sleeves 43, that is, the second bent portion 41, is larger than a quantity of exhaust gas which flows in the outer side of the bent exhaust pipe 20 by an amount that an inner-side flow passage of the exhaust gas is shorter than the outer-side flow passage of the exhaust gas. Accordingly, a larger quantity of exhaust gas is introduced into two inner sleeves 43, and a smaller quantity of exhaust gas is introduced into one inner sleeve 43 thus enhancing the discharge of the exhaust gas to the outside through the muffler.

Figure 9:
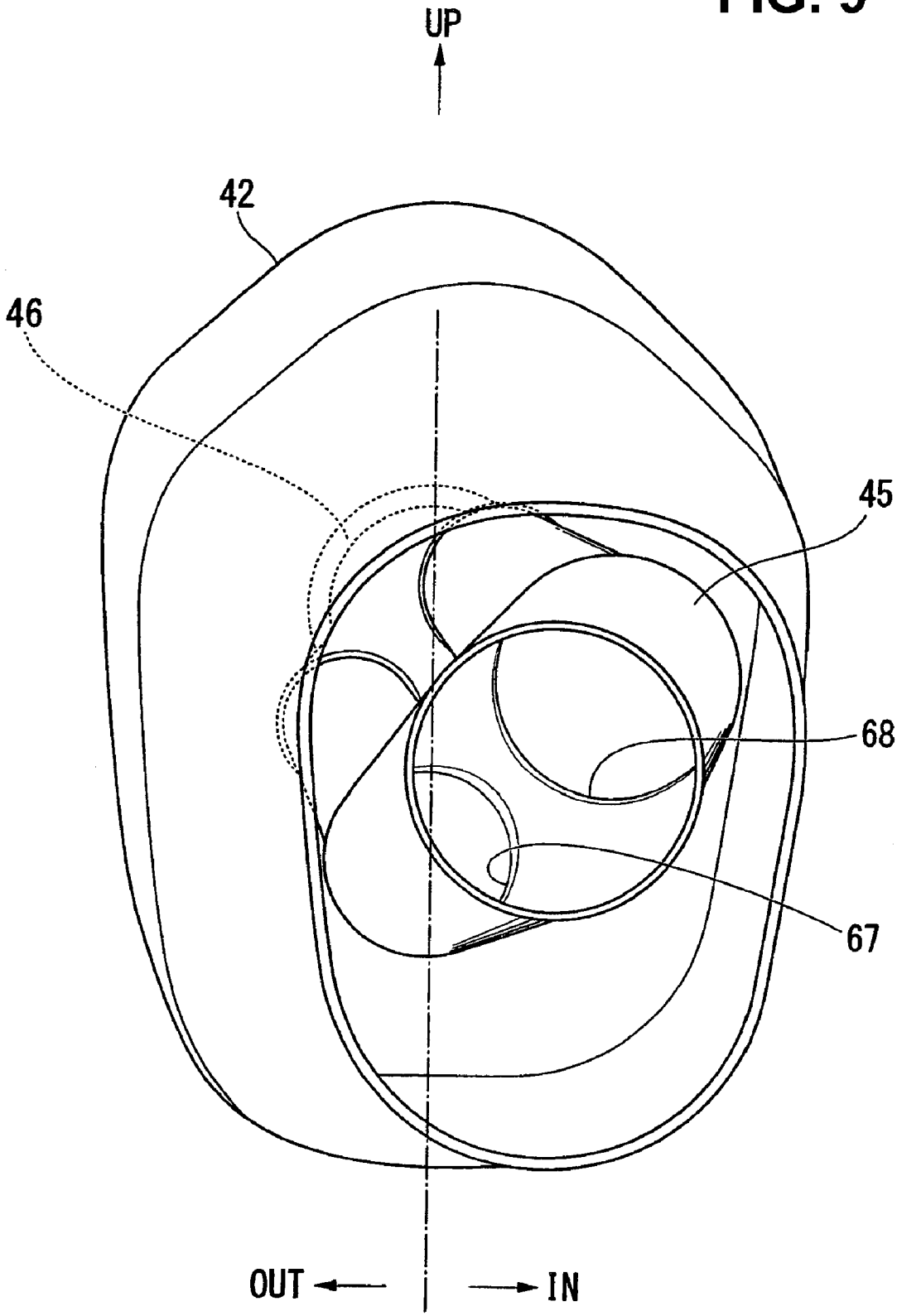
FIG. 9 is a front cross-sectional view of a muffler of a second embodiment corresponding to FIG. 8.
Figure 10:
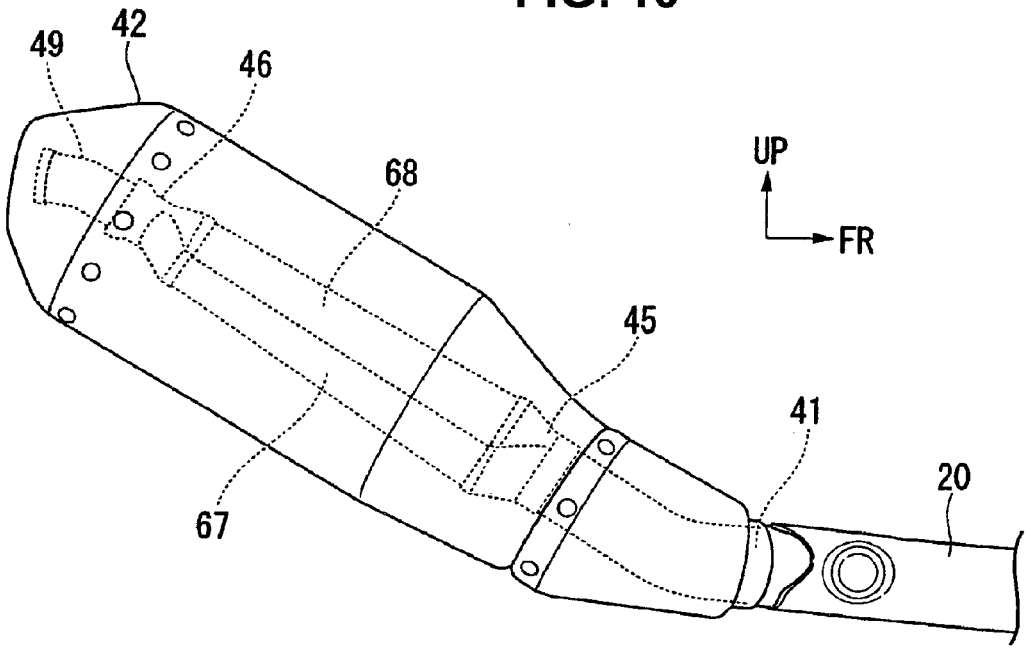
FIG. 10 is a right side plan view of the muffler of the second embodiment.
Figure 11:
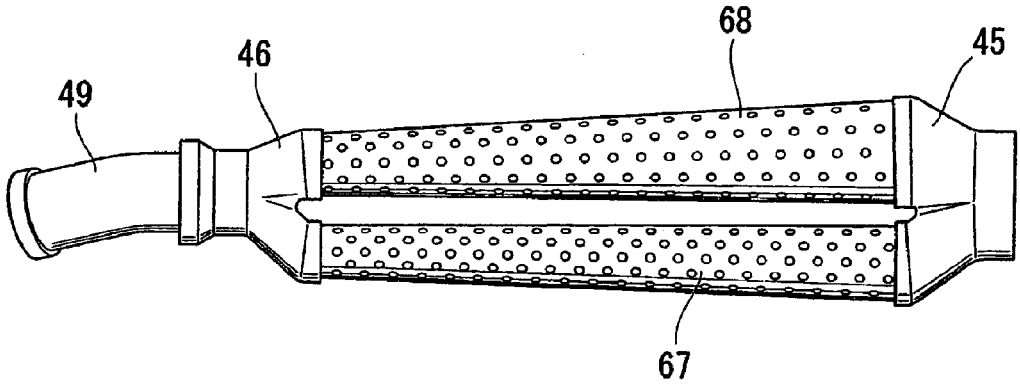
FIG. 11 is a top plan view of inner sleeves of the muffler of the second embodiment.

Next, a second embodiment of the present invention is explained in conjunction with FIG. 9 to FIG. 11. This embodiment is characterized in that, in the above-mentioned first embodiment, in place of providing two inner sleeves 43, 43 corresponding to the frame side of the bent exhaust pipe 20 just in front of the connection portion of the exhaust pipe 20 connected to three inner sleeves 43, that is, in place of providing two inner sleeves 43, 43 corresponding to the frame side of the second bent portion 41, a large-diameter inner sleeve 68 having a cross-sectional area larger than a cross-sectional area of a small-diameter inner sleeve 67 corresponding to the outer side of the second bent portion 41 is provided corresponding to the frame side of the second bent portion 41.

Accordingly, the inner sleeves 67, 68 are arranged such that the large-diameter inner sleeve 68 corresponding to the frame side of the second bent portion 41 is arranged so as to have a cross-sectional area larger than a cross-sectional area of the small-diameter inner sleeve 67 corresponding to the outer side of the second bent portion 41. In this embodiment, out of two inner sleeves 67, 68, the large-diameter inner sleeve 68 is arranged close to the frame side of the second bent portion 41 of the exhaust pipe 20, and the small-diameter inner sleeve 67 is arranged close to the outer side of the second bent portion 41.

Here, the respective inner sleeves 67, 68 are gradually tapered rearwardly and hence, it is possible to increase an inner pressure in the inner sleeves 67, 68 which gradually decreases toward the end cap 49 opened to the atmosphere. Here, other constitutions of this embodiment are substantially equal to the corresponding constitutions of the above-mentioned first embodiment and hence, parts identical with the parts of the first embodiment are given same symbols and their repeated explanation is omitted.

Also in the second embodiment, a total area of the holes h can be increased compared to a case where the single inner sleeve is provided and hence, it is possible to shorten a length of the muffler 22 eventually. Further, a quantity of exhaust gas which flows in the frame side of the second bent portion 41 is larger than a quantity of exhaust gas which flows in the outer side of the second bent portion 41 and hence, the exhaust gas of a larger flow rate is introduced into the large-diameter inner sleeve 68 having a larger cross-sectional area, and the exhaust gas of a smaller flow rate is introduced into the small-diameter inner sleeve 67 whereby it is possible to smoothly discharge the exhaust gas through the muffler. Particularly, it is sufficient for this embodiment to have only two inner sleeves, that is, the large-diameter inner sleeve 68 and the small-diameter inner sleeve 67 and hence, the number of parts and the number of assembling steps can be reduced thus contributing to the reduction of weight of the vehicle body.

Here, the present invention is not limited to the above-mentioned embodiments. For example, the number of the inner sleeves 43 in the first embodiment is not limited to three.

That is, provided that the number of inner sleeves differs between a side where a large quantity of exhaust gas flows and a side where a small quantity of exhaust gas flows, three or more inner sleeves may be provided. Further, in this embodiment, although the explanation has been made by taking the exhaust pipe 20 in which the first bent portion 40 is inclined inwardly and downwardly as an example, provided that the number of inner sleeves which are arranged close to the frame side of the bent portion of the exhaust pipe arranged just in front of the connection portion of the exhaust pipe with the muffler 22 is set larger than the number of inner sleeves which are arranged close to the outer side of the bent portion, the bending direction of the exhaust pipe is not limited.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. A vehicular muffler comprising:

a hollow outer case;

a plurality of tubular inner sleeves, formed of porous material, which are disposed inside of the outer case and which are operatively connected, at a first end thereof, to an exhaust feed pipe;

and an outlet pipe having a first end which is disposed inside of the outer case and which is operatively connected to the respective inner sleeves, said outlet pipe operable to discharge an exhaust gas to an outside environment via an outlet side of the outer case;

wherein the tubular inner sleeves have openings formed therein along substantially the entire length thereof, and are spaced away from each other so as to be out of contact with one another;

wherein the plurality of inner sleeves are connected to the exhaust feed pipe by way of a first expansion chamber comprising:

a first connecting sleeve having a first sleeve diameter thereacross, a substantially disc-shaped enlarged portion disposed adjacent to and downstream from the first connecting sleeve, the enlarged portion having a maximum chamber diameter which is larger than the first sleeve diameter, a neck portion which is reduced in diameter to be smaller than the enlarged portion, and a plurality of outlet-side connecting sleeve portions, wherein the inner sleeves and the first expansion chamber are in fluid communication with one another such that during use, exhaust gas from the exhaust feed pipe flows into and through the disc-shaped enlarged portion and into the tubular inner sleeves;

and wherein the inner sleeves are connected to the outlet pipe by way of a second expansion chamber which is similar in shape to the first expansion chamber.

2. A vehicular muffler according to claim 1, wherein a bent portion is arranged in the vicinity of a connecting portion of the exhaust feed pipe which is connected to the outer case, and the plurality of inner sleeves disposed inside of the outer case are arranged such that the number of inner sleeves disposed proximate a frame side of the bent portion of the exhaust feed pipe is larger than the number of inner sleeves disposed proximate an outer side of the bent portion of the exhaust feed pipe.

3. A vehicular muffler according to claim 1, wherein a bent portion is arranged in the vicinity of a connecting portion of the exhaust feed pipe which is connected to the outer case, and the plurality of inner sleeves disposed inside of the outer case are arranged such that a cross-sectional area of the inner sleeve corresponding to a frame side of the bent portion of the exhaust feed pipe is set larger than a cross-sectional area of the inner sleeve corresponding to an outer side of the bent portion of the exhaust feed pipe.

4. The vehicular muffler of claim 1, wherein the inner sleeves are arranged substantially parallel to one another.

5. The vehicular muffler of claim 1, wherein three sleeves are provided in the outer case, and are arranged to form substantially an equilateral triangle as viewed in cross section.

6. The vehicular muffler of claim 1, wherein two spaced-apart sleeves are provided in the outer case, comprising a first sleeve having a first diameter and a second sleeve having a second diameter which is smaller than the first diameter.

7. The vehicular muffler of claim 1, further comprising a sound-absorbing material disposed in the outer case surrounding the sleeves.

8. The vehicular muffler of claim 1, wherein the outer case comprises a tubular central portion and two end caps which are respectively attached to opposite ends of the central portion.

9. The vehicular muffler of claim 8, wherein the end caps are attached to the tubular central portion by both rivets and welding.

10. A motorcycle comprising the muffler of claim 1.

11. A vehicular muffler comprising:

a hollow outer case;

a plurality of tubular inner sleeves, formed of porous material, which are disposed inside of the outer case and which are operatively connected, at a first end thereof, to an exhaust feed pipe, the inner sleeves arranged substantially parallel to one another;

an outlet pipe having a first end which is disposed inside of the outer case and which is operatively connected to the respective inner sleeves, said outlet pipe operable to discharge an exhaust gas to an outside environment via an outlet side of the outer case through a second end thereof; and a sound-absorbing material disposed in the outer case surrounding the sleeves;

wherein the tubular inner sleeves have openings formed therein along substantially the entire length thereof, and are spaced away from each other so as to be out of contact with one another;

wherein the plurality of inner sleeves are connected to the exhaust feed pipe by way of a first expansion chamber comprising:

a first connecting sleeve having a first sleeve diameter thereacross, a substantially disc-shaped enlarged portion disposed adjacent to and downstream from the first connecting sleeve, the enlarged portion having a maximum chamber diameter which is larger than the first sleeve diameter, a neck portion which is reduced in diameter to be smaller than the enlarged portion, and a plurality of outlet-side connecting sleeve portions, wherein the inner sleeves and the first expansion chamber are in fluid communication with one another such that during use, exhaust gas from the exhaust feed pipe flows into and through the disc-shaped enlarged portion and into the tubular inner sleeves;

and wherein the inner sleeves are connected to the outlet pipe by way of a second expansion chamber which is similar in shape to the first expansion chamber.

12. A vehicular muffler according to claim 11, wherein a bent portion is arranged in the vicinity of a connecting portion of the exhaust feed pipe which is connected to the outer case, and the plurality of inner sleeves disposed inside of the outer case are arranged such that the number of inner sleeves disposed proximate a frame side of the bent portion of the exhaust feed pipe is larger than the number of inner sleeves disposed proximate an outer side of the bent portion of the exhaust feed pipe.

13. A vehicular muffler according to claim 11, wherein a bent portion is arranged in the vicinity of a connecting portion of the exhaust feed pipe which is connected to the outer case, and the plurality of inner sleeves disposed inside of the outer case are arranged such that a cross-sectional area of the inner sleeve corresponding to a frame side of the bent portion of the exhaust feed pipe is set larger than a cross-sectional area of the inner sleeve corresponding to an outer side of the bent portion of the exhaust feed pipe.

14. The vehicular muffler of claim 11, wherein three sleeves are provided in the outer case, and are arranged to form substantially an equilateral triangle as viewed in cross section.

15. The vehicular muffler of claim 11, wherein two spaced-apart sleeves are provided in the outer case, comprising a first sleeve having a first diameter and a second sleeve having a second diameter which is smaller than the first diameter.

16. A motorcycle comprising the vehicular muffler of claim 11.

* * * * *